United States Patent [19]

Seligson

[11] 4,242,890

[45] Jan. 6, 1981

[54] STRIPING BOX WITH MORE THAN ONE YARN FINGER ACTIVATED AT A TIME

[76] Inventor: Charles Seligson, 160 E. 38th St., New York, N.Y. 10016

[21] Appl. No.: 927,218

[22] Filed: Jul. 24, 1978

Related U.S. Application Data

[63] Continuation-in-part of Ser. No. 702,858, Jul. 6, 1976, Pat. No. 4,107,954.

[51] Int. Cl.[3] ..... D04B 15/58

[52] U.S. Cl. ..... 66/133; 66/241

[58] Field of Search ..... 66/133, 138, 156, 50 B, 66/241

[56] References Cited

U.S. PATENT DOCUMENTS

| | | | |
|---|---|---|---|
| 2,543,121 | 2/1951 | Mishcon et al. | 66/138 |
| 3,004,413 | 10/1961 | Felker | 66/50 B |
| 3,620,049 | 11/1971 | Mishcon et al. | 66/138 |
| 3,641,786 | 2/1972 | Burdett et al. | 66/241 X |
| 4,107,954 | 8/1978 | Seligson | 66/138 |

FOREIGN PATENT DOCUMENTS

| | | | |
|---|---|---|---|
| 1128713 | 10/1968 | United Kingdom | 66/138 |
| 1164451 | 9/1969 | United Kingdom | 66/138 |

*Primary Examiner*—Wm. Carter Reynolds
*Attorney, Agent, or Firm*—Michael J. Striker

[57] ABSTRACT

During at least one complete rotation of the needle cylinder of a circular knitting machine, more than one yarn-carrying finger is kept activated at at least one of the machine's striping boxes. Each striping box includes an indexed control drum having axial slots which receive finger-activating jacks. An annular holding spring extends circumferentially of the control drum midway between the drum's axial ends and very tightly holds the axial legs of L-shaped jacks. To simultaneously activate yarn fingers located at opposite axial sides of the holding spring, at least one axial holding slot contains two L-shaped jacks. The axial legs of the two jacks are held in conventional manner beneath the spring, but are each of half-normal thickness, so that their combined thickness equals that of the holding slot for a snug fit therein. The radial legs of the jacks are of full thickness, beginning at a point radially inward of the slot, so that the radial legs are firmly held at the radially outermost portion of the holding slot.

3 Claims, 29 Drawing Figures

FIG. 1
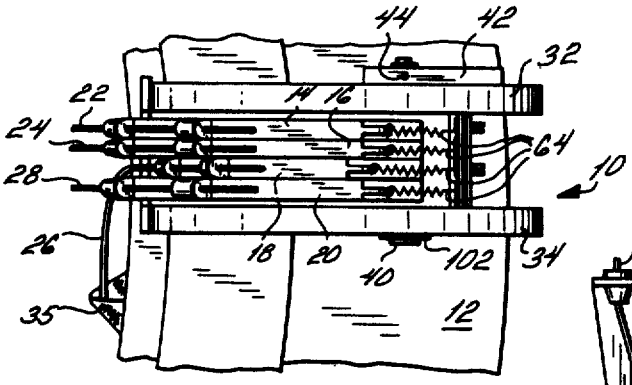
FIG. 2
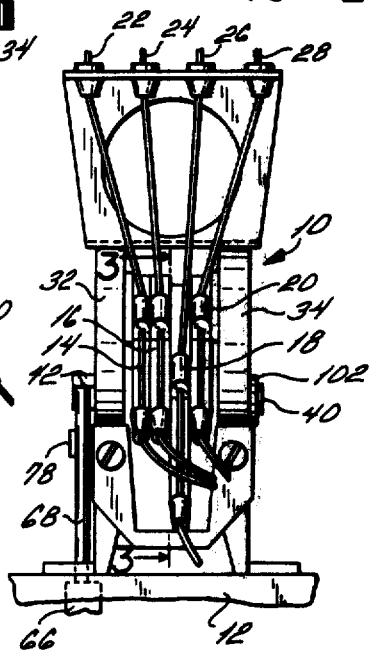
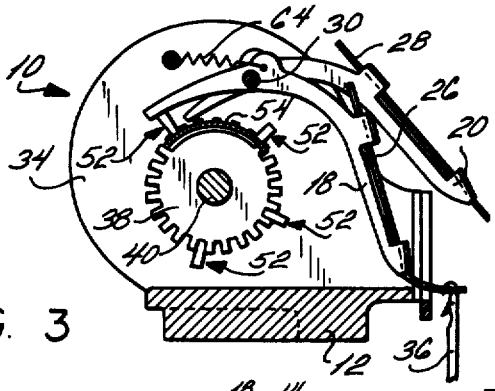
FIG. 3
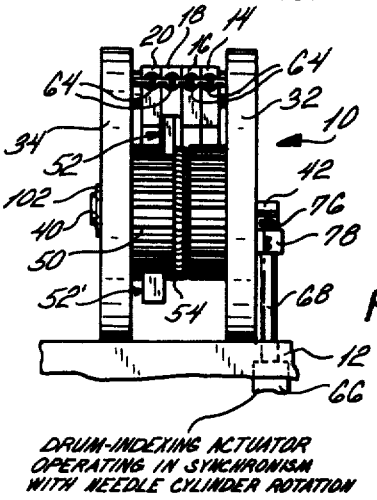
FIG. 4
DRUM-INDEXING ACTUATOR OPERATING IN SYNCHRONISM WITH NEEDLE CYLINDER ROTATION PRIOR ART
FIG. 8
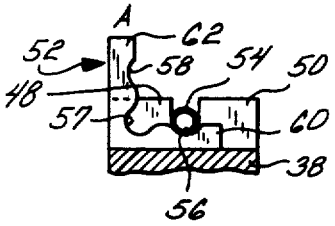
PRIOR ART
FIG. 9
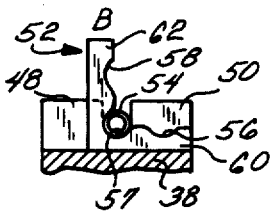
PRIOR ART
FIG. 10
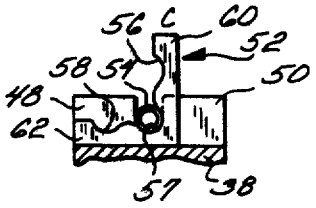
PRIOR ART
FIG. 11
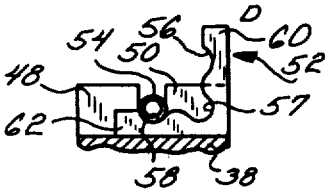
FIG. 12
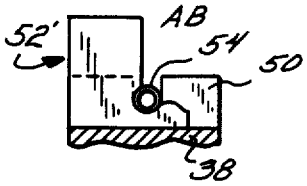
FIG. 13
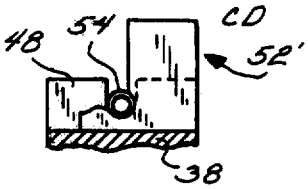
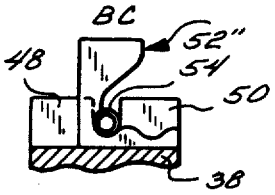
FIG. 14
FIG. 15
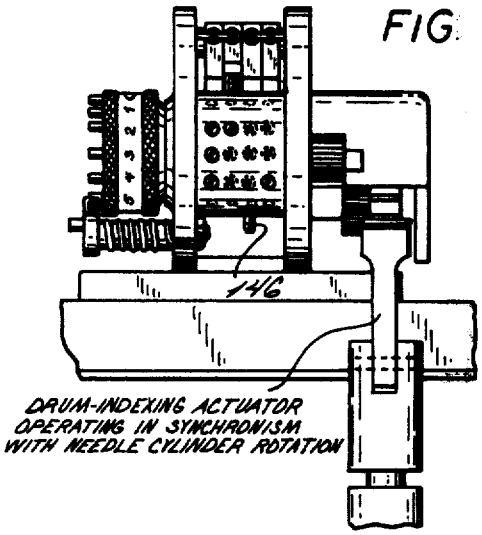

FIG. 20
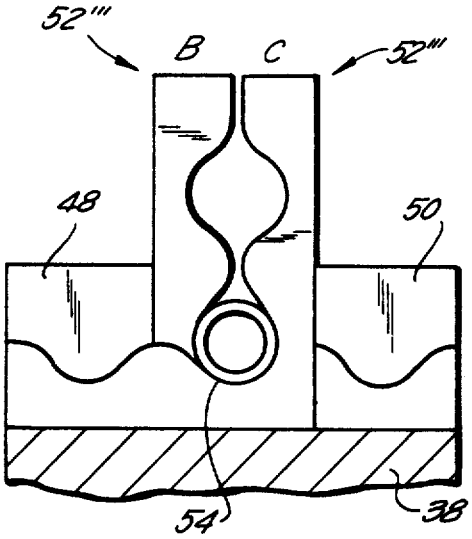
FIG. 21
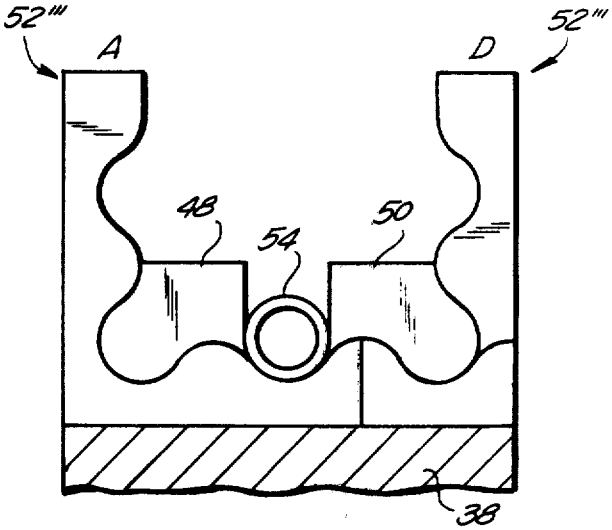
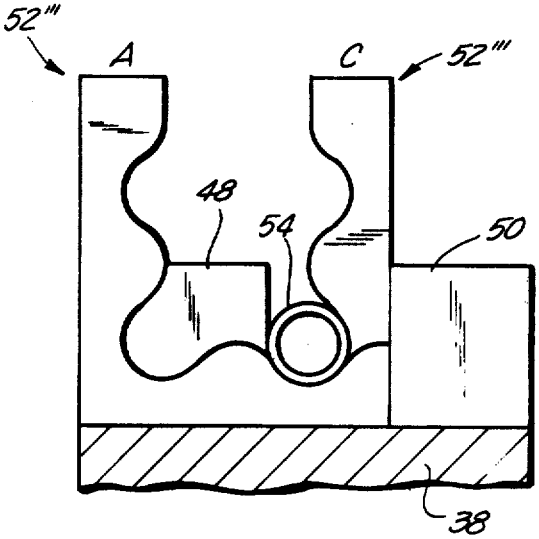
FIG. 22
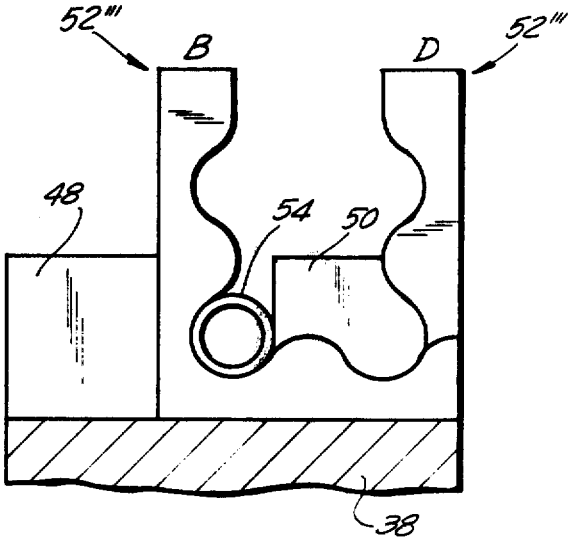
FIG. 23

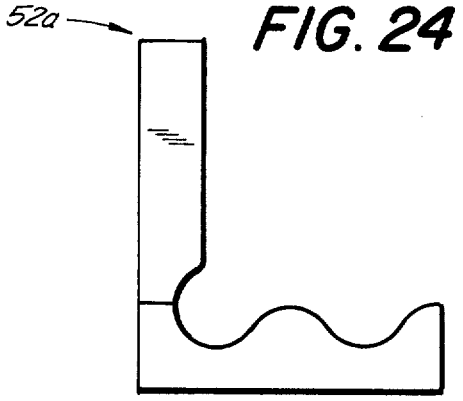
FIG. 24
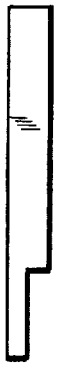
FIG. 25
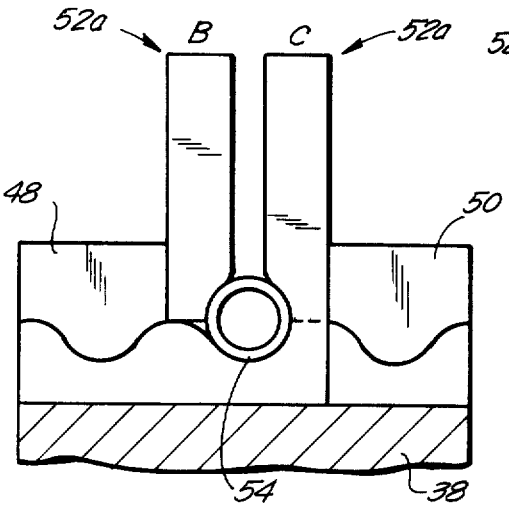
FIG. 26
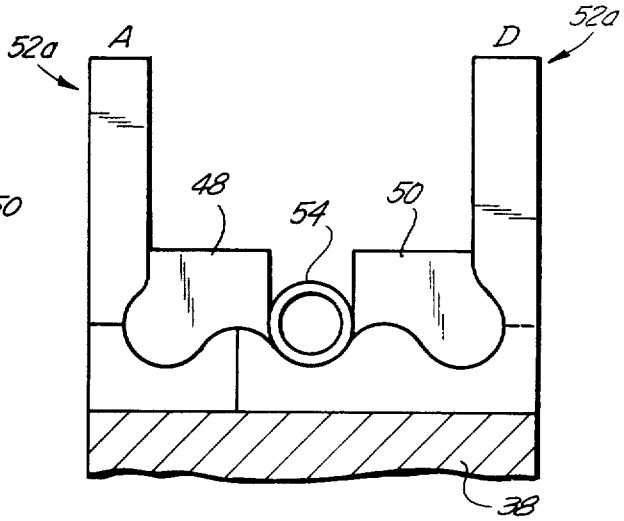
FIG. 28
FIG. 29
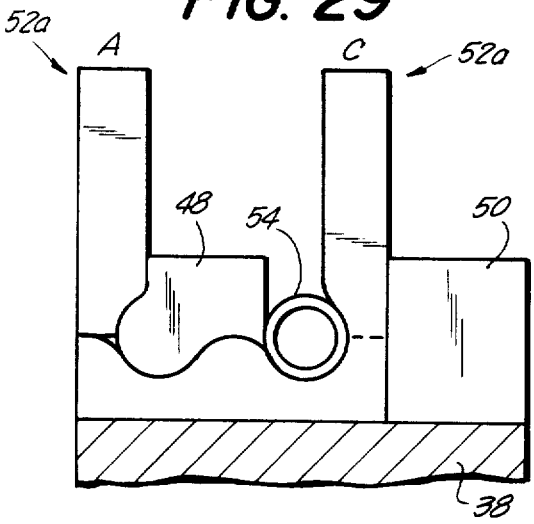
FIG. 27
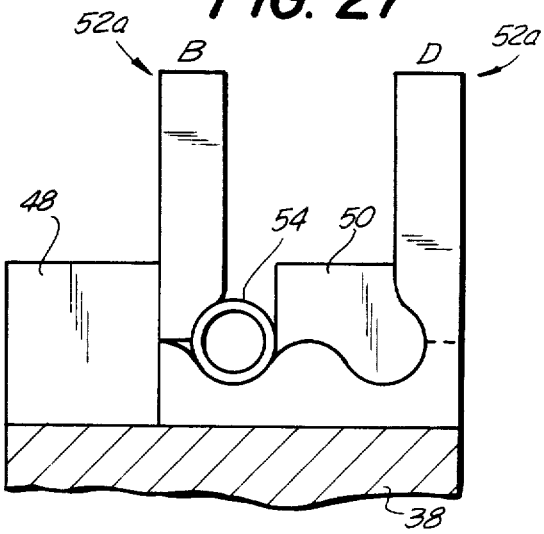

STRIPING BOX WITH MORE THAN ONE YARN FINGER ACTIVATED AT A TIME

CROSS-REFERENCE TO RELATED APPLICATION

The present application is a continuation-in-part of my copending U.S. patent application Ser. No. 702,858 filed July 6, 1976, now U.S. Pat. No. 4,107,954 issued Aug. 22, 1978.

BACKGROUND OF THE INVENTION

The above-identified patent concerns the problem of activating more than one yarn-carrying finger at a striping box of a cirular knitting machine and keeping such plural fingers activated for integral numbers of needle-cylinder rotations when the selection of yarn-carrying fingers is performed using an indexed control drum having axial slots which receive L-shaped finger-activating jacks. That patent discloses several ways of activating different combinations of fingers. For the case where the control drum is provided with a holding spring midway between its ends, for holding down and properly positioning the axial legs of such L-shaped jacks, problems arise when simultaneously activating yarn-carrying fingers located to opposite axial sides of the holding spring. Typically, the holding spring is so strong and tight that an attempt to insert beneath it a jack having two radial legs which are to be located to either side of the holding spring, e.g., to activate the middle two of four yarn-carrying fingers of the striping box, is exceedingly difficult when not simply impossible; striping boxes of this type are designed for activating one yarn-carrying finger at a time, and do not naturally lend themselves to activation of frequently changing combinations of e.g., two fingers at a time, the two fingers being located, at least sometimes, at axially opposite sides of the holding spring.

SUMMARY OF THE INVENTION

For the specific purpose of being able to activate two yarn-carrying fingers simultaneously, located to axially opposite sides of the holding spring, I provide at least one axial holding slot of the control drum with two finger-activating jacks of generally L-shape. The axial legs of the two jacks are of half-normal thickness, and are held beneath the holding spring in conventional manner; their combined thickness accordingly, equals the thickness of the holding slot, achieving a sufficiently snug and rigid holding action at this portion of the plural-jack structure. In contrast, the radial legs of the two jacks are of normal thickness, beginning at a point radially inward of the radially outermost part of the axial holding slot. In this way, the radial leg of each jack individually is snugly held in the radially outer part of the holding slot, creating an overall snugness and rigidity of fit comparable to what is conventionally achieved and desirable for reliable operation. Furthermore, using half-thickness axial legs and full-thickness radial legs, the camming action performed by the radial legs is the same for both jacks and the same as conventionally achieved. Also, because the radial legs are of normal full thickness, their mechanical resistance to break-off is substantially identical to what is conventionally achieved.

Although such an interlocking pair of jacks, insertable from opposide sides of the holding spring, was developed to overcome the difficulty stated above, more general features became evident, i.e., apart from the problem of the tightness and strength of the central holding spring. When using more than one jack per axial holding slot, to activate more than one yarn finger at a time, it becomes possible to activate, for example, six different combinations of two fingers in a four-finger striping box using jacks of fewer than six different shapes and, in the extreme, using jacks which are all of the same shape. Thus, the concept of inserting plural discrete jacks in one such axial holding slot relates both to the problem of activating jacks located to opposite sides of the tight holding spring and, more generally, relates to patterning flexibility apart from the holding-spring problem.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a fragmentary top plan view showing the striping box of the invention on a circular knitting machine;

FIG. 2 is an elevational view of the striping box of FIG. 1 taken from the inside of the circular knitting machine;

FIG. 3 is a diagrammatic cross sectional view on the plane of the line 3—3 of FIG. 2;

FIG. 4 is an elevational view of the striping box of FIG. 1 taken from the outside of the circular knitting machine;

FIG. 8 is a fragmentary sectional view showing a conventional finger-actuating jack in one position between drum teeth;

FIG. 9 is a fragmentary sectional view showing the jack of FIG. 8 in a second position between the drum teeth;

FIG. 10 is a fragmentary sectional view showing the jack in a third position between the drum teeth;

FIG. 11 is a fragmentary sectional view showing the jack in a fourth position between the drum teeth;

FIG. 12 is a view similar to FIG. 8 showing one novel jack in a first position between the drum teeth;

FIG. 13 is a view showing the jack of FIG. 12 in a second position between the drum teeth;

FIG. 14 depicts a further novel jack in position between the drum teeth;

FIG. 15 depicts a striping-box control drum of different design wherein the jacks are replaced by removable control pins;

FIGS. 18–23 depict how, using two half-thickness jacks such as shown in FIG. 16, six different combinations of two fingers each can be activated on a four-finger striping box;

FIG. 24 depicts a novel jack whose radial leg is of full or normal thickness and whose axial leg is of half-normal thickness;

FIG. 25 is an end view of the jack of FIG. 24; and

FIGS. 26–29 depict how two jacks such as shown in FIGS. 24–25 can be interlocked to activate four different combinations of two yarn fingers each, the two yarn fingers in each combination being located to opposite sides of the central holding spring.

DESCRIPTION OF THE PREFERRED EMBODIMENTS

Figure 5:
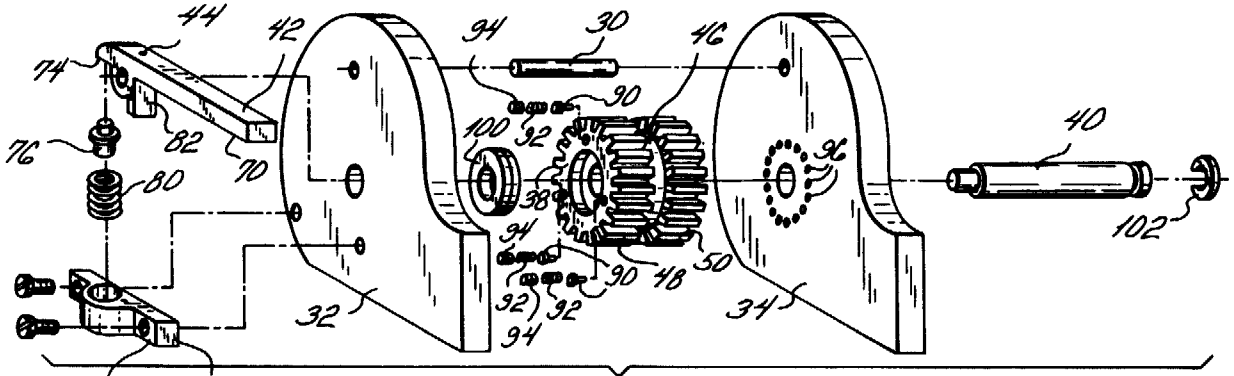
FIG. 5 is an enlarged exploded view showing portions of the striping box of FIG. 1.
Figure 6:
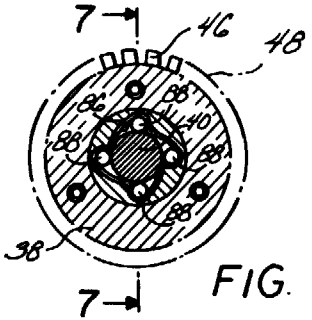
FIG. 6 is a cross sectional view of the drum of the striping box.
Figure 7:
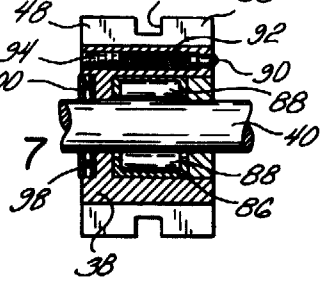
FIG. 7 is a sectional view taken on the plane of line 7—7 of FIG. 6.

FIGS. 1–15 are identical to FIGS. 1–15 of parent application Ser. No. 702,858 filed July 6, 1976, now U.S. Pat. No. 4,107,954, granted Aug. 22, 1978. The entire disclosure of that patent is incorporated herein by reference, and reference is made to that patent for a detailed description of FIGS. 1–15.

The present invention concerns complicated patterning effects created by keeping two yarn-feeding fingers at a striping box of a circular knitting machine activated throughout the duration of at least one complete needle-cylinder rotation. For the sake of concreteness, this is described below with respect to a four-fingered striping box, having four yarn-feeding fingers 14, 16, 18, 20 (see FIGS. 2–4). The striping box is provided with an indexed control drum 38 (see FIGS. 3–5). The drum 38 has an annular groove 46 midway between its axial ends (FIG. 5) and is provided with a circumferential succession of teeth 48, 50 to the two sides of groove 46, defining axial slots which receive finger-activating jacks 52. Mounted in annular groove 46 is a holding spring 54 which extends around the circumference of drum 38. Jacks 52 inserted into the axial slots are held beneath the holding spring 54. Typically, the jacks are provided with recesses (e.g., 56, 57, 58 in FIG. 8), which are engaged by holding spring 54, so that the spring not merely hold the jacks but properly position them in axial direction as well. Typically, the holding spring 54 is an extremely tight and strong spring which cannot be removed from the control drum, and certainly is not removed from the control drum as a matter of practice when inserting and removing finger-activating jacks 52. Typically, the holding spring 54 is so tight and strong that it cannot be displaced radially outward of the control drum a distance equal to the height of the jacks, the height of the jacks being their total dimension measured in the radial direction of the control drum. Instead, one leg of the jack is merely slid under the holding spring 54, with the spring 54 yielding radially outwardly at most a very small amount; indeed considerable force may be required to push a leg of such a jack into proper position beneath the holding spring. As shown in FIGS. 8–11, the radially outward extending projections of the finger-activating jacks assume one of four positions A, B, C, D, for activating a respective one of the four yarn-feeding fingers. FIGS. 12–14 depict jacks configured to make possible the simultaneous activation of the left two fingers (hereafter referred to as fingers A and B), the right two fingers (hereafter referred to as fingers C and D), and the middle two fingers (fingers B and C), respectively.

Very unusual effects can be achieved by dropping two fingers at a time, in frequently changing combinations. To do this with an axial-slot control drum of the type in question, in contrast for example to the pin-type control drum shown in FIG. 15, is very problematic. This type of axial-slot control drum is designed for operation on a one-finger-at-a-time basis, and does not naturally lend itself to double activation, and certainly not to simultaneous activation of two fingers at a time in frequently changing combinations. For the patterning effects in question, it is desirable that all possible combinations of at least two fingers each be available. There are six combinations of two fingers each possible in a four-fingered striping box: AB, AC, AD, BC, BD, and CD.

Combinations AB and CD can be implemented in the manner shown in FIGS. 12 and 13, with no more difficulty when inserting jacks than is encountered with conventional jacks such as shown in FIGS. 8–11.

Combination BC is made problematic by the presence of the holding spring. FIG. 14 depicts one solution of this problem. The radially outward end of the jack 52″ is in effect cantilevered in the rightwards direction, so that the radially outward end of the jack can be located to both sides of the midway-located holding spring 54. With tight holding springs of the type typical, a single jack, having two axially spaced radial projections which are to hold spring 54 between them would be all but impossible to insert into the drum. Although the jack 52″ shown in FIG. 14 achieves a solution to this problem, difficulties may be encountered when the radial dimension of the jack is not to be as large as shown; in that event, the rightwardly cantilevered part of the jack (which activates fingers BC), may be connected to the base of the jack, i.e., at the radially outermost edge of the teeth 48, 50, by a web of material too thin for requisite strength. Thus, although the jack 52″ of FIG. 14 can be inserted as easily as a conventional single-finger jack, problems may arise in certain situations.

Combination AD presents clear problems. Attempts to achieve this combination in a way similar to the BC combination achieved in FIG. 14 would require a rather complex configuration, involving a fairly considerable amount of machining expense, and would raise serious problems of break-off, even when the radial dimension of the jack can be as large as shown in FIG. 14. If the radial dimension of the jack were to be smaller, there could be very serious problems of break-off. Similar remarks apply to combinations AC and BD, i.e., to all combinations where the two fingers to be activated are located to opposite sides of the holding spring 54 and do not directly adjoin (BC). Indeed, as already mentioned, similar problems can arise even with combination BC.

Besides the problem of structural strength and excessively complex jack configuration, it will also be clear that if attempts were made to achieve all six combinations in the manner of FIGS. 12–14 (combinations AD, AC and BD in the spirit of FIG. 14), this furthermore will require the use of at least four different shapes of jacks: one for AB and CD (FIGS. 12 and 13); one for BC (FIG. 14); one for AD; and a fourth one for AC and BD. Also, it will of course be necessary to keep on hand conventional one-finger jacks.

The present invention introduces the use of plural finger-activating jacks in at least some of the slots of the control drum of the type of striping box in question. This provides a way to reliably achieve all six combinations AB, AC, AD, BC, BD and CD in the first place, and also brings about the possibility of important secondary advantages.

Figure 16:
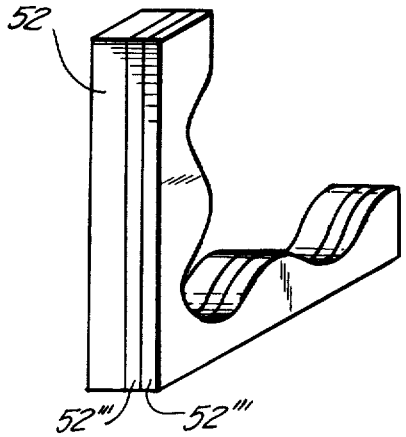
FIG. 16 depicts two half-thickness jacks alongside a normal-thickness jack.
Figure 17:
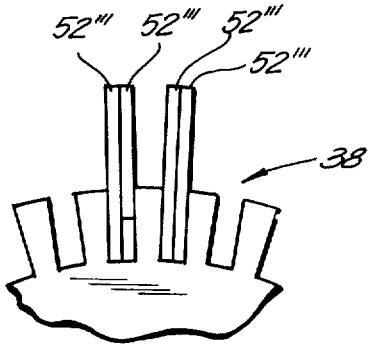
FIG. 17 shows two half-thickness jacks in each of two axial holding slots of the control drum.
Figure 18:
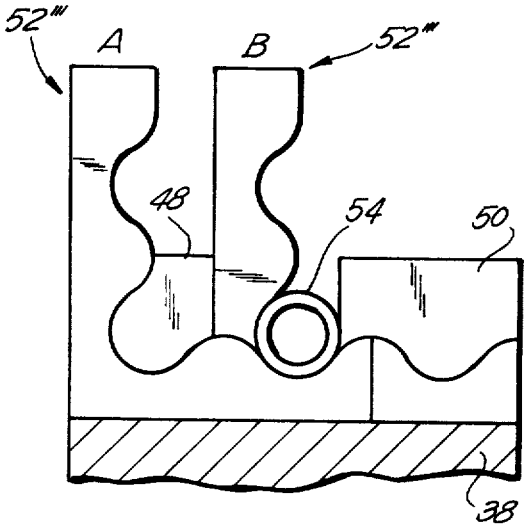
Figure 19:
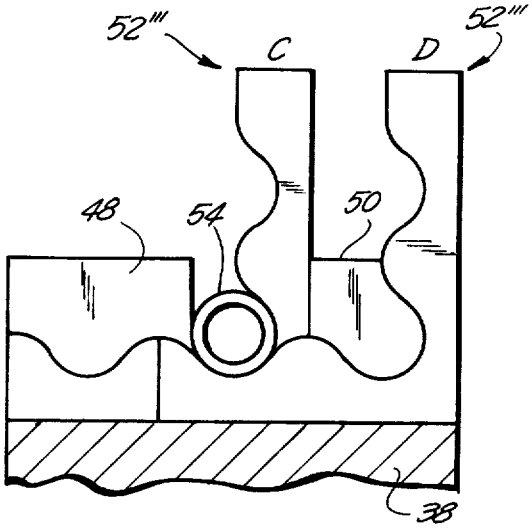

In its simplest form, the inventive jack can be identical to the conventional jacks 52 shown in FIGS. 8–11, but of one half the thickness thereof. FIG. 16 depicts one conventional jack 52, and alongside it two novel jacks 52''', to illustrate this. FIG. 17 depicts two circumferentially successive axial slots of the control drum 38, each slot containing two jacks 52'''.

FIGS. 18–23 depict how, using only two such jacks 52''', all six of the combinations in question can be achieved. Additionally, it will be appreciated that, by arranging two such jacks 52''' exactly congruent, they can be made to form the equivalent of a conventional single-finger jack 52, and therefore be arranged in any of the four ways shown in FIGS. 8–11. Although the radially outwardly extending finger-activating projections of the jacks, when arranged as in FIGS. 18–23, are of only one half normal thickness, it is to be noted that the bases of these jack pairs, received within the axial slots, are in effect of full or normal thickness, and therefore can be firmly held in the slots with an acceptable degree of firmness.

Although the simple half-thickness, but otherwise conventional jacks 52''' offer the possibility of using a single shape of jack for all ten situations of interest (FIGS. 8–11 and 18–23), the embodiment of the inventive concept which is at present actually preferred and considered best is different, and is devised not merely to create the combinations of interest, but also to achieve snug and rigid fit within the holding slots, mechanical strength and resistance to break-off, and camming action per se all on a par with conventional, one-finger-activating jacks 52.

The presently preferred jack **25*a* is depicted in FIGS. 24 and 25. As most clearly seen in FIG. 25, the jack 25*a* can, at simplest, be more or less the same as a conventional jack 52, but the entirety of its axially extending leg is machined down to one-half normal thickness. The portion of the jack located radially outward of the axially extending leg is kept at normal thickness. When such a jack 52*a* is inserted into the axial slot of the control drum 38 and positioned beneath the holding spring 54**, the base of the normal-thickness part of the jack is snugly received within the radially outward part of the axial slot. I.e., the radially outward part of the jack in the holding slot includes a portion which has a thickness equal to the thickness of the slot and is located radially inward of the radially outermost part of the slot so that such portion be snugly held by the slot at the radially outermost part of the slot.

FIGS. 26–29 depict how two such jacks **52*a***, identical to each other, can be employed to develop each one of combinations BC, BD, AD and AC, respectively.

In FIG. 26, combination BC is achieved. The left one of the two illustrated jacks is inserted into the slot in the control drum, until its leftmost recess engages under holding spring 54. The portion of this jack located beneath (radially inward) of holding spring 54 is of one-half normal thickness. The normal-thickness part of this jack **52*a* is, to a considerable extent, located within the holding slot itself, and thus is quite snugly and rigidly held. This left jack 52*a* activates finger B. The right one of the two jacks is inserted into the control drum slot, until its rightmost recess engages under holding spring 54. The half-thickness axially extending part of the right jack is located in front of the half-thickness axially extending part of the left jack, as seen by the viewer in FIG. 26**. In the zone where the two half-thickness axially extending legs of the two jacks overlap, they together present to the axial slot a full or normal-thickness structure, which can be snugly and rigidly held within the holding slot. The full-thickness part of the right jack is again, to a very considerable extent, located within the axial holding slot itself, and thereby snugly and rigidly held.

It will be appreciated that this overlapping or interlocking jack pair **52*a*, 52*a* presents, overall, a structure whose thickness is full or normal, and therefore can be held by the axial holding slot and holding spring 54 with a degree of snugness and ridigity comparable to that with which a conventional jack 52 can be held. Furthermore, the radially outward extending legs of the jacks, being of full or normal thickness, present identical camming structures to the finger-activating levers, or the like, of the striping box. Furthermore, because the radially outward extending legs of these two jacks are of normal thickness, and rooted within the axial holding slot of the control drum at portions of normal thickness, their resistance to break-off is virtually the same as for a conventional jack 52. It will be noted that the radial legs of these two jacks, in contrast to their axial legs, are not provided with a third holding recess (such as recess 58 in FIGS. 8–12), because these full-thickness legs will not be laid into the axial slots of the control drum 38. To maximize the fraction of the jack which can stay at full or normal thickness, the ledge (see FIG. 25**) of the jack should be located as low as possible, i.e., just high enough for the half-thickness axial leg of the cooperating jack to be accommodated beneath it.

Whereas FIG. 26 depicts combination BC, FIG. 27 shows how to achieve combination BD by simply shifting the right jack **52*a* rightwards, until its left recess engages beneath the holding spring 54**. The comments made above with respect to snugness of fit within the holding slot and identicalness of camming action of course apply here likewise.

FIG. 28 depicts how to achieve combination AD, by shifting the left jack in FIG. 27 leftward until its right holding recess engages below holding spring 54. Likewise, FIG. 29 depicts how to achieve combination AC, by shifting the right jack in FIG. 28 leftward until its right holding recess engages below holding spring 54.

It will be understood that each of the elements described above, or two or more together, may also find a useful application in other types of constructions differing from the types described above.

While the invention has been illustrated and described as embodied in the context of a particular type of striping box having four yarn-feeding fingers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a striping box for circular knitting machines comprised of a rotating needle cylinder having cylinder needles, a plurality of yarn-carrying fingers, each finger being individually movable between an inoperative position and an operative position in which it feeds the yarn it carries to cylinder needles receiving yarn from the striping box; and means operative in synchronism with needle cylinder rotation for causing more than one of the yarn-carrying fingers to move into and stay in the operative position throughout at least one complete rotation of the needle cylinder to feed yarn from more than one finger at a time to cylinder needles receiving yarn from the striping box during the at least one complete rotation, said means comprising a control drum provided with a circumferential succession of axial holding slots for holding finger-activating jacks, an indexing arrangement operative for indexing the control drum slot-by-slot at preselected intervals each corresponding to at least one complete rotation of the needle cylinder, at least one of the axial holding slots accommodating a plurality of discrete finger-activating jacks, each of the plurality of discrete finger-activating jacks having a leg projecting radially outward from the control drum for finger activation, the projecting legs of respective ones of the plurality of discrete jacks in the axial holding slot being differently located for activating different respective ones of the yarn-carrying fingers of the striping box, each of the individual ones of the plurality of discrete jacks in said at least one holding slot having a radially inward part located radially inward of the radially outermost part of the holding slot and a radially outward part including the respective projecting leg thereof, the radially inward parts of the plurality of discrete jacks each having a thickness less than the thickness of the holding slot, the combined thicknesses of the radially inward parts of the plurality of jacks in the slot being equal to the thickness of the slot for a snug fit in the slot, the radially outward part of each individual one of the plurality of discrete jacks in said at least one holding slot being at least equal to the thickness of the holding slot.

2. In a striping box as defined in claim 1, the length of at least one of the plurality of jacks as measured in the axial direction of the control drum being smaller than the axial length of the holding slot and that jack being axially shiftable to different positions in which its projecting leg activates different respective ones of the yarn-carrying fingers of the striping box.

3. In a striping box as defined in claim 1, the radially outward part of each individual one of the plurality of discrete jacks in said at least one holding slot including a portion which has a thickness equal to the thickness of the slot and is located radially inward of the radially outermost part of the slot so that such portion is snugly held by the slot at the radially outermost part of the slot.

* * * * *